US012331536B2

(12) United States Patent
Gobeille

(10) Patent No.: US 12,331,536 B2
(45) Date of Patent: Jun. 17, 2025

(54) REMOVABLY MOUNTABLE TEMPORARY WORK SURFACE

(71) Applicant: Matt Gobeille, Bend, OR (US)

(72) Inventor: Matt Gobeille, Bend, OR (US)

( * ) Notice: Subject to any disclaimer, the term of this patent is extended or adjusted under 35 U.S.C. 154(b) by 192 days.

(21) Appl. No.: 17/808,419

(22) Filed: Jun. 23, 2022

(65) Prior Publication Data

US 2023/0072609 A1 Mar. 9, 2023

Related U.S. Application Data

(60) Provisional application No. 63/261,043, filed on Sep. 9, 2021.

(51) Int. Cl.
*E04G 5/06* (2006.01)

(52) U.S. Cl.
CPC ..... *E04G 5/067* (2013.01); *E04F 2201/06* (2013.01); *E04G 2005/068* (2013.01)

(58) Field of Classification Search
CPC ..... E04G 5/067; E04G 2005/068; E04G 5/08; E04F 2201/06
USPC ..... 108/147.12, 147.15, 107; 248/441.1, 248/442.2, 447, 447.2
See application file for complete search history.

(56) References Cited

U.S. PATENT DOCUMENTS 1,758,440 A 5/1930 Goodwin
5,799,917 A * 9/1998 Li ..... F16M 13/022 248/921
6,098,552 A 8/2000 Gunderson
D585,326 S * 1/2009 Donaldson ..... D11/117
8,191,487 B2 * 6/2012 Theesfeld ..... F16M 11/24 108/50.01
8,668,257 B2 * 3/2014 Wu ..... A47C 7/70 248/446
8,763,755 B2 7/2014 Hagberg
10,610,010 B2 * 4/2020 Matlin ..... F16M 11/2014
10,767,372 B1 9/2020 Hansen
2001/0035486 A1 * 11/2001 Pryor ..... A47B 23/025 248/447.2
2005/0156085 A1 * 7/2005 Radovan ..... A46B 17/02 248/213.2
2006/0124817 A1 * 6/2006 White ..... A47G 7/045 248/339
2008/0029663 A1 * 2/2008 Derry ..... F16M 11/10 248/178.1
2023/0072609 A1 * 3/2023 Gobeille ..... E04G 5/067

* cited by examiner

*Primary Examiner* — Muhammad Ijaz
(74) *Attorney, Agent, or Firm* — Scott Seeley; Eastgate IP

(57) ABSTRACT

A removably mountable temporary work surface is disclosed herein. In some embodiments, the removably mountable temporary work surface includes a toolless mounting bracket, a spacing bar, and a hinge affixed to a work surface. The toolless mounting bracket may be configured to mount to construction framing. The spacing bar can be configured to extend or retract for use and storage. In various configurations, the work surface may include a metallic material and include one or more mechanisms to secure contents to the work surface, such as magnetic tethers. The work surface can be sized to form a substantially contiguous surface when mounted to adjacent framing posts.

19 Claims, 13 Drawing Sheets

REMOVABLY MOUNTABLE TEMPORARY WORK SURFACE

CROSS REFERENCE TO RELATED APPLICATIONS

This patent application claims the benefit of U.S. Prov. Ser. No. 63/261,043 filed Sep. 9, 2021. That application is incorporated by reference herein.

BACKGROUND

Field

The present disclosure generally relates to temporary work surfaces that can be quickly and easily mounted to various mounting surfaces such as the framework used in the construction of housing and other buildings. In various configurations, the device disclosed herein can be quickly and easily dismounted, compacted, and relocated without necessitating the use of additional tools or adjustment.

Background

Many environments make it difficult to establish a long-term workspace. For example, construction sites are often left unfurnished and are subject to change on a daily basis, making it cumbersome to establish a permanent workspace solution. Nevertheless, individuals working at these sites often require a place to store documents, prepare plans, review blueprints, mark up diagrams, and the like.

SUMMARY

The present disclosure relates to removably mountable temporary work surfaces, and various techniques and methods relating thereto. In some embodiments, the removably mountable temporary work surfaces disclosed herein may comprise: a mounting system; a spacing bar; and a work surface connected to the spacing bar by a hinge. In various configurations, the mounting system comprises a friction fit bracket having no moving parts. In these, or different embodiments, the friction fit bracket may be configured to mount to construction framing. In many different configurations, the systems disclosed herein may include a magnetic attachment mechanism. In some of these and other configurations, a magnetic attachment mechanism may include at least two magnets affixed to opposite ends of a flexible tether. In some configurations, a magnetic attachment mechanism may include a single magnet affixed to the worksurface by a flexible tether. In some embodiments the magnetic attachment mechanism includes a magnet disposed within a housing affixed to a tether removably mountable to the work surface. Likewise, in various configurations the work surface includes a metallic material configured to interface with the magnetic attachment mechanism.

In some configurations, the friction fit bracket implemented in the disclosed devices may include at least three internal edges and a lateral gap, configured such that: the first internal edge is disposed parallel to the second internal edge; the first and second internal edges are separated by a third internal edge that is disposed perpendicular to the first and second internal edges, such that the third internal edge is disposed parallel to the lateral gap. In some configurations the lateral gap may be at least partially defined by the non-connecting ends of the outcroppings or other members defining the fourth and fifth internal edges.

In the same or different configuration, the removably mountable temporary work surface may comprise: a mounting system including a friction fit bracket, wherein the friction fit bracket has at least three internal edges and a lateral gap, configured such that: the first internal edge is disposed parallel to the second internal edge; the first and second internal edges are separated by, and connected to, a third internal edge disposed perpendicular to the first and second internal edges and the lateral gap; wherein the first internal edge is further connected to a fourth internal edge parallel to the third internal edge; and wherein the second internal edge is further connected to a fifth internal edge parallel to the third internal edge. In various configurations, the first internal edge has a length of about 1.5"; the second internal edge has a length of about 1.5"; and the third internal edge has a length of about 6.25". In some of these and other configurations the first internal edge is connected to a fourth internal edge having a length of about 0.625"; and the second internal edge is connected to a fifth internal edge having a length of about 0.625". In these and different configurations the non-connecting ends of the members defining the fourth and fifth internal edges may define the lateral gap.

Likewise, in various embodiments, the first and second edges may include a polymer covering. In the same or different embodiment, the first and second edges may include a grooved surface. The grooves may include teeth, barbs, prongs, or any of a variety of other textured outcroppings. The grooves or polymer coating can be configured to increase the friction of the friction fit bracket, or otherwise increase the stability of the mount.

In many embodiments the systems disclosed herein comprise a spacing bar. In some of these configurations, the spacing bar may include at least two locking mechanisms disposed along the length of the spacing bar; and a C-channel configured to slide along the length of the spacing bar and to interface with the one or more of the at least two locking mechanisms to lock the C-channel at one or more predetermined point along the length of the spacing bar. In some of these and other embodiments, the at least two locking mechanisms include at least one ball-spring interface. In various configurations the work surface is affixed to the spacing bar by a hinge configured to provide at least one axis of movement to the work surface. In many embodiments the work surface includes a lower lip.

In many advantageous configurations, the work surface is sized to form a contiguous surface when a plurality of devices is mounted to adjacent framing posts. In some embodiments the work surface has a width selected from about 14.5", about 16", about 22.5", or about 24".

Many particularly advantageous configurations of the devices disclosed herein relate to a removably mountable temporary work surface configured to be mounted to construction framing. In some configurations, the removably mountable temporary work surface comprises: a mounting system including a friction fit bracket; wherein the friction fit bracket has at least five internal edges and a lateral gap. The internal edges and gap may be configured such that: the first internal edge has a length of about 1.5", is disposed parallel to the second internal edge, and is connected to a member defining a fourth internal edge having a length of about 0.625"; the second internal edge has a length of about 1.5", is separated from the first internal edge by a third internal edge having a length of about 6.25", and is disposed perpendicular to the first and second internal edges, such that the third internal edge is disposed parallel to the lateral gap; the second internal edge is further connected to a member defining a fifth internal edge having a length of about 0.625"; wherein the non-connecting ends of the members defining the fourth and fifth internal edges define the lateral gap disposed parallel to the third internal edge. In some of these embodiments the devices comprise a spacing bar including: at least two locking mechanisms disposed along the length of the spacing bar; and a C-channel configured to slide along the length of the spacing bar and to interface with the one or more of the at least two locking mechanisms to lock the C-channel at one or more predetermined point along the length of the spacing bar. In many of these configurations the device further includes a work surface prepared from a metallic material having: a width of about 14.5"; and at least one magnetic attachment mechanism including two magnetic elements affixed by a flexible tether.

BRIEF DESCRIPTION OF DRAWINGS

Various embodiments are depicted in the accompanying drawings for illustrative purposes and should in no way be interpreted as limiting the scope of the embodiments. Various features of different disclosed embodiments can be combined to form additional embodiments, which are part of this disclosure.

DETAILED DESCRIPTION INCLUDING PREFERRED EMBODIMENT

Figure 1:
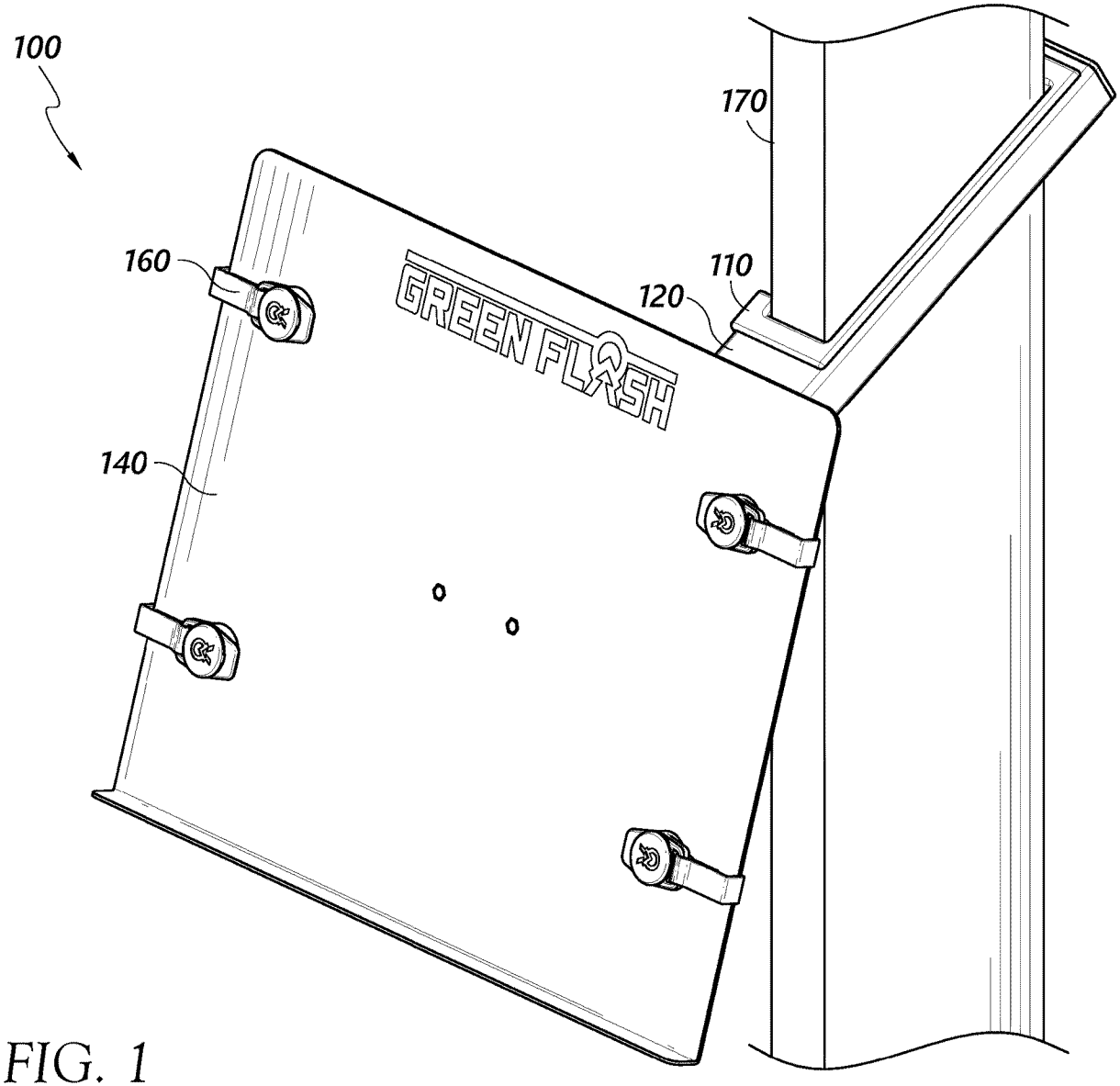
FIG. 1 presents a perspective view of an embodiment of a removably mountable temporary work surface mounted to framing.

Various systems and methods relating to removably mountable temporary work surfaces are described below to illustrate selected examples that may achieve one or more desired improvements. These examples are only illustrative and not intended in any way to restrict the general disclosure presented or the various aspects and features described herein. Furthermore, the general principles described herein may be applied to embodiments and applications other than those specifically discussed herein without departing from the spirit and scope of the disclosure. This disclosure is not limited to any particular embodiment shown but is instead to be accorded the widest scope consistent with the principles and features that are disclosed or suggested.

Overview

Past attempts to provide temporary workspace solutions present several significant disadvantages. For example, most temporary workspace solutions come in multiple different pieces, requiring that the user keep track of, store, and transport all the disparate elements of the device to and from the desired location. Such workspace solutions frequently require the user to perform elaborate routines to build or set up the temporary workstation, and many require the use of additional tools to complete the process.

Further, many temporary workstations rely on complicated mounting mechanisms that add significant time and inconvenience to the process. For instance, many temporary workstations utilize complicated mounting mechanisms that rely on the user adjusting the mounting mechanism to clamp down around an outcropping of some compatible size. Some mechanisms utilize large amounts of clamping force which can damage the mounting substrate. Other mounting mechanisms rely on drilling screws or other attachment devices into the mounting surface which damages the mounting surface and prevents such workstations from being mounted to many otherwise available surfaces.

Disclosed herein is a removably mountable temporary work surface, including embodiments that overcome these disadvantages. In some embodiments, the removably mountable temporary work surface can be quickly and easily mounted to a beam or post without the use of additional tools by utilizing a toolless mounting bracket. In many configurations, the device is collapsible and transportable a s a single unit that does not need to be disassembled or reassembled. In this manner, the removably mountable temporary work surface disclosed herein provides a convenient and easy to use workspace that can be mounted, dismounted, and relocated with ease. Further, the toolless mounting bracket can be adjusted up or down the length of the beam or post to which it was mounted in order to manipulate the height of the device to set the height at the preferred level for a user without completely dismounting the device.

In various embodiments, the disclosed removably mountable temporary work surface can be configured to mount to a variety of mounting substrates without requiring additional adjustment to mount, and without damaging the mounting surface. In some particularly advantageous configurations, the removably mountable temporary work surface is configured for use in a construction setting. For example, the device can be configured to mount to the beams and posts used in house framing, and the work surface can be sized such that when multiple devices are mounted on adjacent framing posts, a substantially contiguous surface is created. In some embodiments, the device can be painted a high visibility color for safety that does not conflict with other safety colors frequently found on a construction site. For instance, in some configurations, a high visibility safety color such as green is selected, which does not conflict with the yellow or orange high visibility colors typically found on construction sites.

FIG. 1 depicts an embodiment of a removably mountable temporary work surface device 100 mounted to a framing post 170. As shown, the removably mountable temporary work surface device 100 includes a work surface 140, a spacing bar 120, and a toolless mounting bracket 110. In the embodiment depicted in FIG. 1, the work surface may include at least one magnetic mechanism 160 for securing contents to the work surface 140. As depicted in FIG. 1, the toolless mounting bracket 110 can be configured to mount to a beam, pole, framing, post, or the like without requiring the use of tools and without requiring adjustment to complete the mount. In this manner, the device 100 disclosed herein can provide a convenient and temporary work surface that can be mounted quickly, and can further be dismounted, stored, or relocated efficiently without damaging the mounting substrate.

Figure 2A:
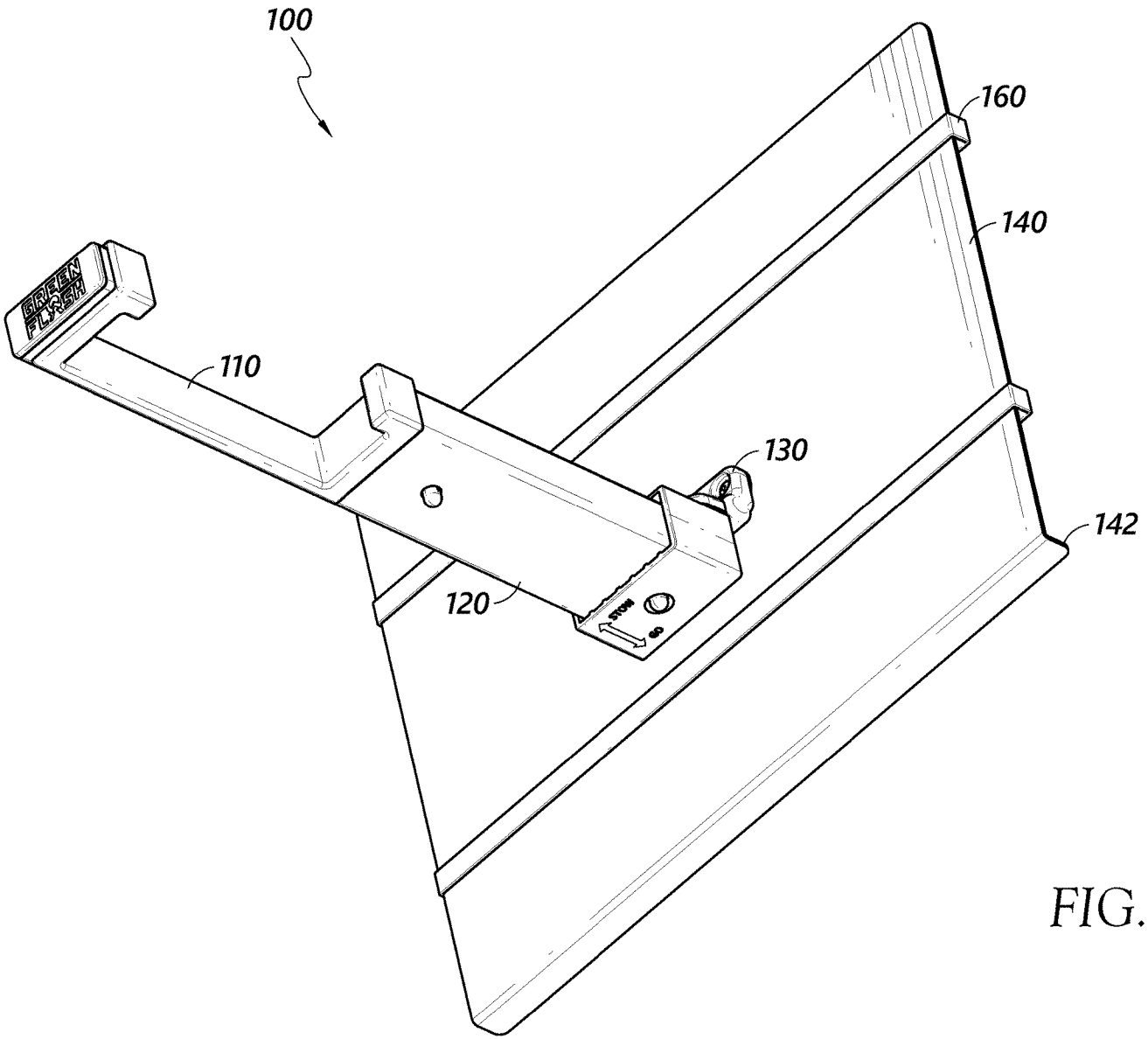
FIGS. 2A-C present an orthographic view, side view, and top down view of a removably mountable temporary work surface.
Figure 2C:
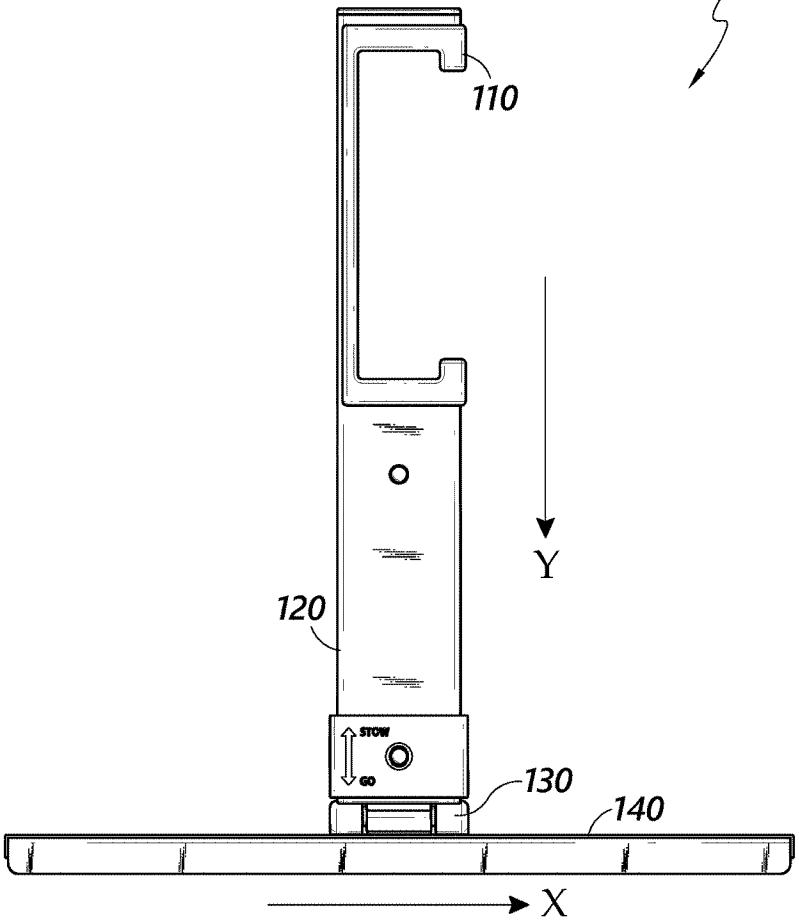
Figure 2B:
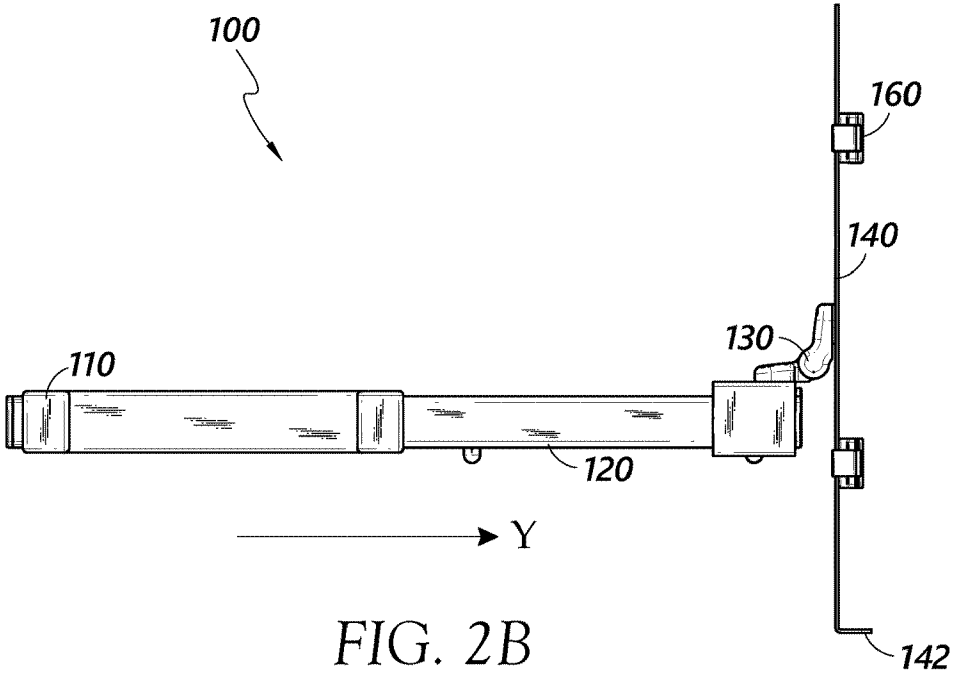

FIGS. 2A-C depict additional, alternate views of an embodiment of a removably mountable temporary work surface device 100 in which various advantageous features can be seen. FIG. 2A presents an orthographic view of a removably mountable temporary work surface device 100 prepared in accordance with this disclosure. FIG. 2B presents a lateral view of the device 100, while FIG. 2C presents a top-down view of the device 100. As shown in FIGS. 2A-C, the removably mountable temporary work surface has a longitudinal axis Y, a lateral axis X, and further includes a toolless mounting bracket 110, a spacing bar 120, a hinge 130, and a work surface 140. In the illustrated embodiment, the work surface includes a lip 142 along the lower edge, and a plurality of magnetic mechanisms 160—wherein the magnetic mechanisms are tethered around the back of the work surface 140 or removably affixed to each corner of the work surface 140. In this manner, the magnetic mechanisms 160 may interface with the work surface 140 to retain items and documents placed thereon, even in windy or gusty environment such as an unfinished construction site.

Mounting Bracket

Figure 3C:
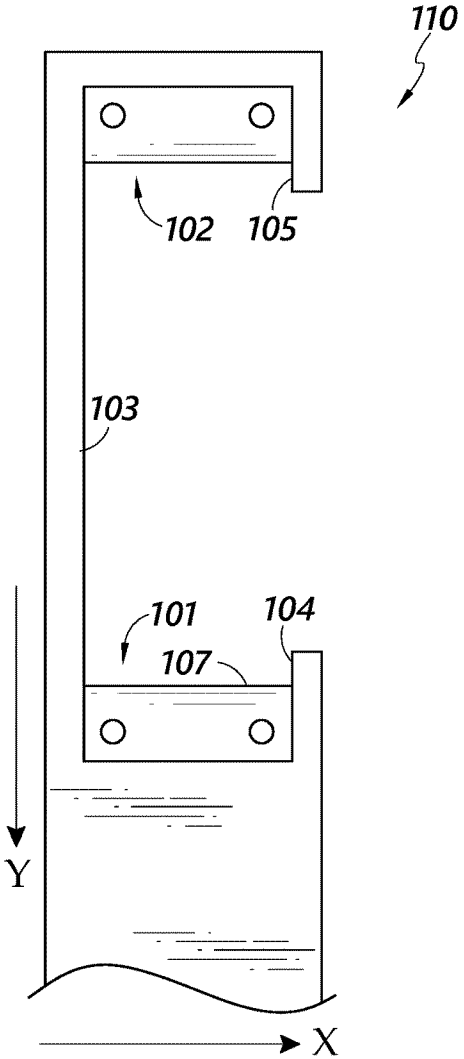
FIGS. 3A-C depict various embodiments of a toolless mounting bracket for use in a removably mountable temporary work surface.
Figure 3B:
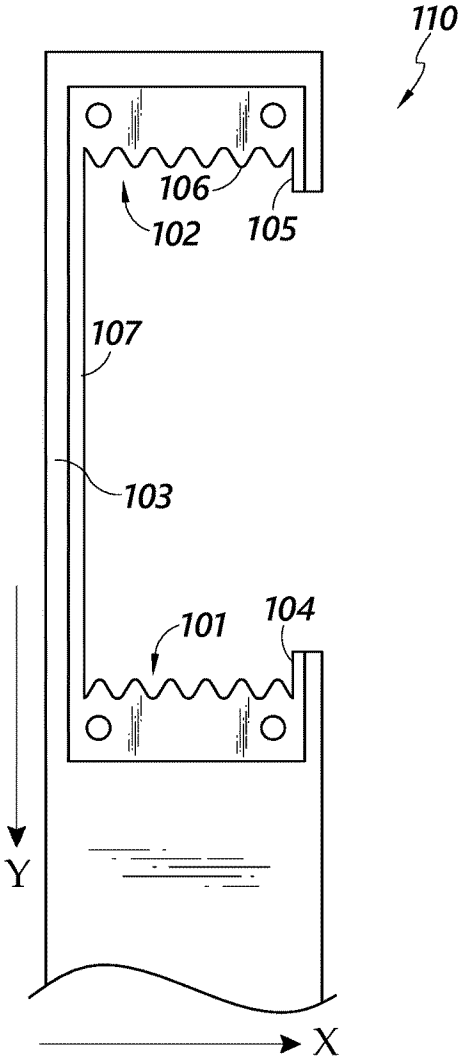
Figure 3A:
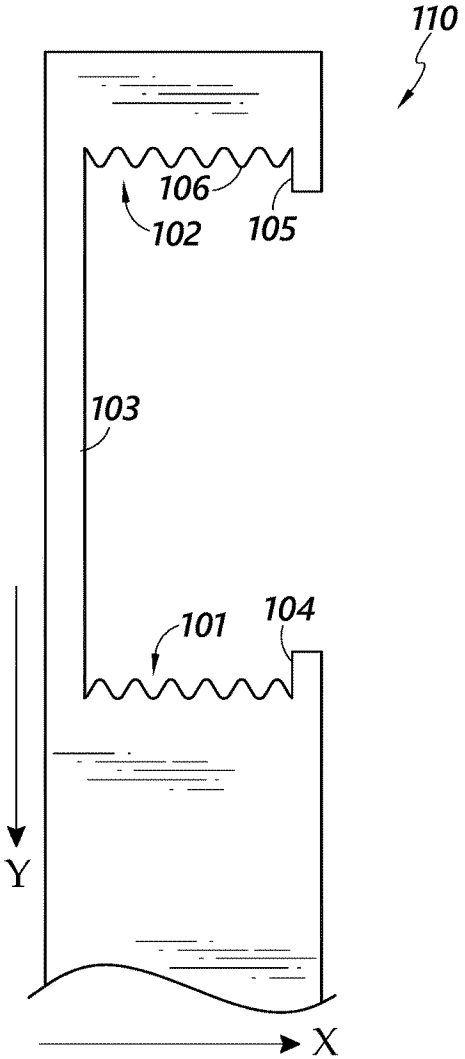

FIGS. 3A-C depicts various embodiments of a toolless mounting bracket 110. In various configurations, the toolless mounting bracket 110 can be configured to interface with a post, beam, frame, or the like without requiring the use of additional tools or adjustment. Since the toolless mounting bracket mounts quickly and easily in a simple process that does not necessitate the use of additional tools or adjustment of the apparatus, the height of the device can be manipulated by altering the vertical position of the toolless mounting bracket 110 with respect to the substrate to which it is mounted. In this manner, the overall height of the device can be quickly and easily set to a desired configuration for a particular user. In some embodiments, the toolless mounting bracket 110 can be specially adapted for use in particular environments, such as a construction site where permanent workspaces may be uncommon or difficult to find, and where the environment is subject to change, necessitating that the work surface be relocatable. For example, the embodiments depicted in FIGS. 3A-C can be configured for use in a construction setting and can further be configured to interface with house framing.

In some configurations the toolless mounting bracket 110 may be a substantially rectangular member comprising at least three edges, as depicted in FIGS. 3A-C. In this configuration, the toolless mounting bracket may include two opposing edges 101, 102 disposed along the longitudinal access of the device Y. The two opposing edges may be connected by a third edge 130 running perpendicular to both opposing edges 101, 102 such that the toolless mounting bracket forms a contiguous member.

Through the use of these three edges, the toolless mounting bracket can be mounted to a beam, post, or frame by inserting the beam, frame, or post between the first 101, second 102, and third internal edges 103. When properly mounted, the weight of the device 100, including especially the weight of the work surface 140, exerts a downward force along the first edge 101 against the mounting substrate. The downward force exerted by the first edge 101 against the mounting substrate in turn creates an upward force along the second edge 102, causing the second edge 102 to rise upwards. As such, the downward force exerted by the first edge 101 on the mounting substrate is countered by the upward force exerted by the second edge 102 on the mounting substrate, and the opposing forces tension the device 100 onto the beam, post, frame, or other substrate to which it is mounted. The mount is further stabilized by the third edge 103 which prevents the device from slipping off a side of the beam or post along the device's lateral axis X. In this manner, the toolless mounting bracket allows the device to be quickly and easily mounted and does not require any further adjustment to complete the mount.

Utilizing this efficient mounting mechanism, the height of the apparatus can be quickly and easily adjusted without dismounting the device from the beam, post, or other mounting substrate. For instance, a user may lift the device 100 to relieve the force exerted along the first 101 and second 102 edges, allowing the device to be adjusted vertically with respect to the mounting substrate. In this manner, the device 100 can be raised or lowered into a desired configuration.

In some configurations, such as those depicted in FIGS. 3A-C, the toolless mounting bracket further includes one or more of a fourth 104 and fifth 105 supporting edge disposed opposite the third edge 103. The fourth 104 and fifth 105 supporting edges can be connected to the first 101 and second 102 edges respectively. Commonly, a gap is left between the ends of the fourth 104 and fifth 105 supporting edges to leave room for the mounting beam or post to be inserted into the bracket. In various embodiments, the fourth 104 and fifth 105 edges provide additional support along the lateral axis X of the mounting device against the mounting substrate and reduce the likelihood that the device 100 will become misadjusted or dislodged from the beam, post, or other substrate to which the device 100 is mounted.

In some configurations, one or more of the edges may include additional features. For example, as shown in FIGS. 3A-B, in some embodiments the toolless mounting bracket 110 may include grooves, contours, or teeth 106. The contours 106 may be disposed along one or more of the interior edges 101, 102, 103, 104, 105. For example, in some embodiments, the contours 106 are disposed along the interior of the first 101 and second 102 edges as shown in FIG. 3A. The contours 106 may be machined into the edge, or configured as part of a coating, covering, or insert disposed along one or more of the internal edges of the bracket 110. The contours 106 can be utilized to improve the stability of the mount. For example, the contours 106 can bite into the mounting substrate to further reduce the likelihood that the device 100 will be dislodged or become misadjusted during use.

Likewise, in some embodiments one or more of the edges may be comprise a coating, covering, insert, or the like. A coating, covering, or insert may be used to improve the stability of the mount and to reduce the likelihood of damaging the mounting substrate. FIGS. 3B-C depict embodiments of a toolless mounting bracket 110 which includes a coating, covering, or insert 107 disposed along the interior edges of the bracket 110. Suitable coatings may include high friction coatings to prevent the device from falling off the beam or post to which it is mounted. Other coatings may include padding to prevent the device from damaging the beam or post to which it is mounted. For example, in some embodiments, the edges may include a polymer coating, such as a high friction rubber coating that will reduce the likelihood that the device will become dislodged from the beam or post to which it is mounted, and further reduce the likelihood that the device will damage the beam or post when mounting or while the work surface is in use. In various configurations, a separate insert may be employed in which the insert comprises a polymer, such as a high friction rubber, and the insert may interface with a bevel implemented along one or more of the interior edges 101, 102, 103, 104, 105. In various configurations, the insert, coating, or covering may include a single piece or may comprise multiple portions.

As described above, the removably mountable temporary work surface disclosed herein can be configured for use in a particular setting. For instance, in some configurations the toolless mounting bracket can be configured for use in construction sites by arranging the toolless mounting bracket to mount quickly and easily to the beams and posts commonly used in house framing.

The boards and planks used in house framing typically have a nominal size of about 2"×4", 2"×6", or about 2"×8". It will be appreciated that the nominal size typically differs from the board's actual dimensions. In practice, a nominal 2"×4" typically has actual dimensions of about 1.5"×3.5". Likewise, a nominal 2"×6" board typically has dimensions of about 1.5" by about 5.5", while a 2"×8" board typically has actual dimensions of about 1.5"×7.25".

Accordingly, in various advantageous configurations, the removably mountable temporary work surface disclosed herein can be configured to mount to the 2"×4", 2"×6", and 2"×8" boards typically used in house framing and other construction. Specifically, in some configurations the toolless mounting bracket may have internal dimensions of about 1.5" by about 6.25" as measured along the first 101 and third 103 edges. In this manner, the device is configured to interface with the beams and posts used in construction of houses or other buildings to provide a suitable temporary workspace in those environments. In the same or different configuration, the fourth and fifth edges may have a length of about 0.625" to help secure the device to the post and reduce the chance that the device will become inadvertently dislodged.

However, it will be appreciated that the toolless mounting bracket can be prepared using a variety of other dimensions and can be configured to mount to a variety of surfaces or outcroppings. For instance, in some configurations, the toolless mounting bracket may have internal dimensions measured along the first 101 and third 103 edges of about 1.5" by about 9", about 1.5" by about 14", or any value therein such as 1.5" by about 10". In the same or different embodiment, the fourth 104 and fifth 105 edges may be about 5% to about 45% of the length of the third edge 103. Likewise, in certain configurations, the toolless mounting bracket may have internal dimensions measured along the first 101 and third 103 edges of about 0.75" by about 1.5", 0.75" by about 2.0", 0.75" by about 4", or any value therein.

From the foregoing, it will be appreciated that the toolless mounting bracket can be configured to mount to any of a variety of standard board sizes, ranging from about 1"×2" to about 2"×8", but that additional variations are contemplated by this disclosure and the toolless mounting bracket can be configured to mount to nearly any sized board. When configuring the mounting bracket to fit a specified board size, it can be helpful to ensure the long edge includes at least about an additional half inch or greater than the width of the board to which the mounting bracket is being configured to mount in view of the foregoing. In some embodiments, the bracket is sized about 0.75" greater than the width of the board the device will be mounted to. For instance, in some configurations the device may be configured to mount to a board having an actual dimension of about 1.5"×5.5", and the device bracket may be sized about 1.5"×6.25" or to a board having an actual dimension of about 1.5"×3.5" and the device may have dimensions of about 1.5"×4.25". As such, the device can be mounted to any of the standard board sizes typically used in construction framing.

Spacing Bar

As shown in FIGS. 4A-4G, the toolless mounting bracket 110 is connected to a spacing bar 120. In some embodiments, the toolless mounting bracket 110 and spacing bar 120 may be formed as a single, monolithic, contiguous piece. In other configurations, the spacing bar 120 may be connected or otherwise secured to the mounting bracket through the use of bolts, brackets, rivets, welds, friction fittings, or the like. Likewise, in some configurations the spacing bar 120 may include at least two sections such as the embodiment depicted FIG. 4A. In other configurations, the spacing bar 120 in be formed from a single piece, such as the embodiment depicted in FIG. 4B.

In many configurations, the spacing bar 120 serves to separate the work surface 140 from the mounting bracket 110 and to allow the work surface 140 to be positioned a comfortable distance from the substrate to which the device 100 is mounted. In some configurations, the spacing bar 120 can be adjustable, or may include other features. For instance, in various embodiments the spacing bar 120 can be configured to allow the device 100 to telescope, collapse, expand, or otherwise retract and extend. In such advantageous configurations, the work surface 140 can be positioned at various distances from the mounting substrate to allow for more convenient and comfortable use of the work surface 140. Furthermore, by configuring the spacing bar 120 to allow the device 100 to extend and retract, the device 100 can be compacted for storage and repositioning to reduce the amount of space and effort required for transport and storage. In other embodiments, the spacing bar 120 may include additional features, such as compartments, openings, or additional fittings. By way of example, in some embodiments, the spacing bar 120 can be configured to hold items within. In some embodiments, the spacing bar 120 can be configured to hold smaller items such as pens and the like within a compartment disposed along the longitudinal axis of the spacing bar 120. In other configurations, the spacing bar 120 may include compartments sized to fit other devices, such as batteries or cabling.

In some configurations, the spacing bar 120 may be configured to allow the device 100 to telescope, extend, or retract. For example, in some embodiments such as the embodiment depicted in FIG. 4A, spacing bar 120 may include a first portion 121 disposed adjacent to the toolless mounting bracket 110 and a second portion 122 disposed adjacent to the work surface 140 and connected to the hinge 130. In the depicted embodiment, the first portion 121 of the spacing bar 120 is substantially hollow and sized to receive the second portion 122 of the spacing bar 120. In this manner, the second portion 122 of the spacing bar 120 may slide along the longitudinal access of the device Y, at least partially within the first substantially hollow portion 121, to extend or retract the spacing bar 120 and thereby extend or retract the device 100.

In the illustrated configuration, the spacing bar 120 is locked in place in an extended configuration by ball spring interface 123. The ball spring interface 123 extends through both the first 121 and second 122 portion of the spacing bar 120, and thereby locks the positions of each portion of the spacing bar 120 relative to one another to maintain the device 100 in an extended configuration.

To retract the device, the ball spring interface 123 can be depressed so that the second insertable portion of the spacing bar 122 may be moved relative to the first substantially hollow portion of the spacing bar 121 to collapse the device 100 along its longitudinal axis Y. Once in a collapsed state, the device can be locked in place through the use of a second ball spring interface 124 disposed adjacent to the toolless mounting bracket 110 and extending through both the first 121 and second 122 portions of the spacing bar 120.

Figure 4C:
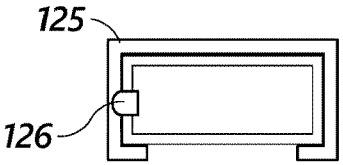
FIGS. 4A-G depict several embodiments of various collapsing mechanisms suitable for use in a removably mountable temporary work surface.
Figure 4B:
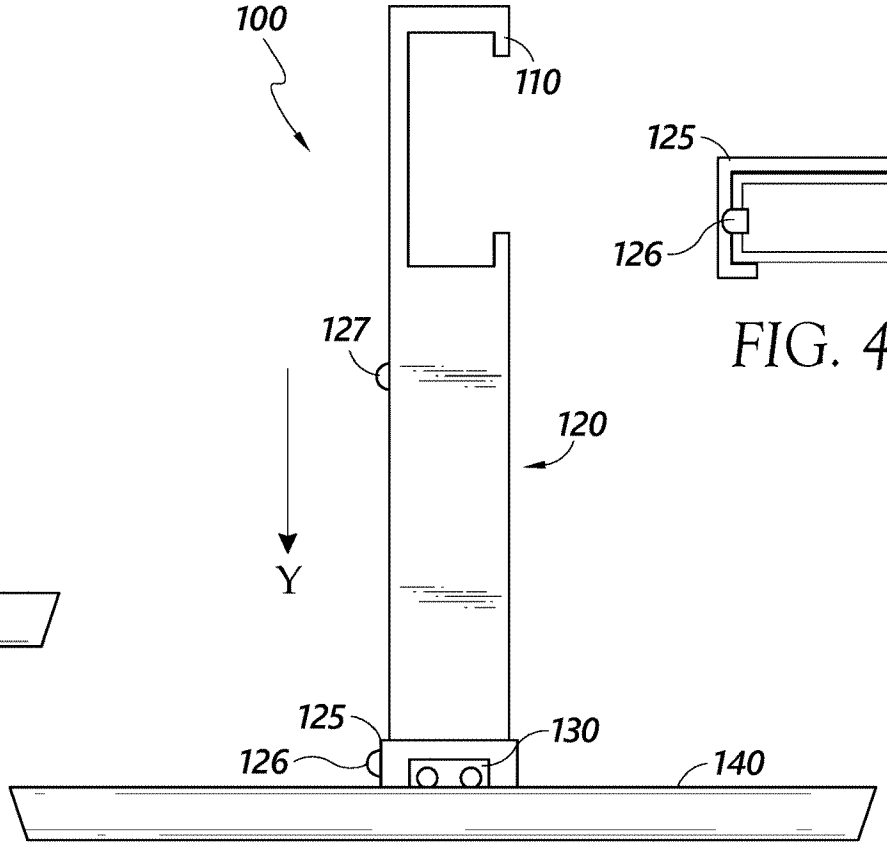
Figure 4A:
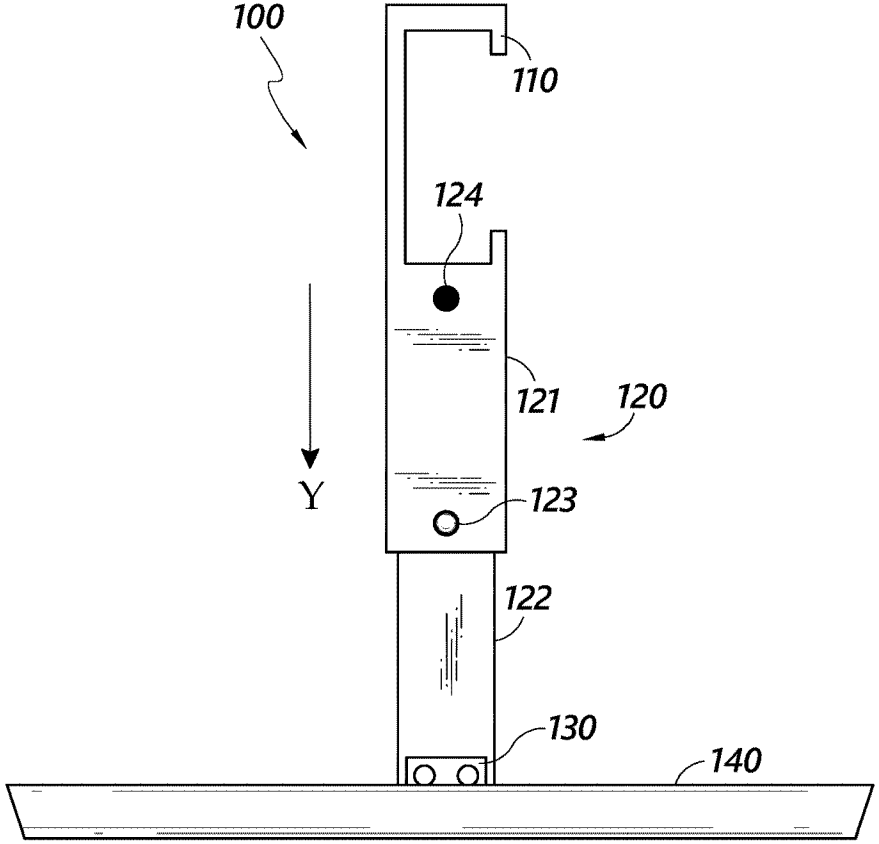
Figure 4E:
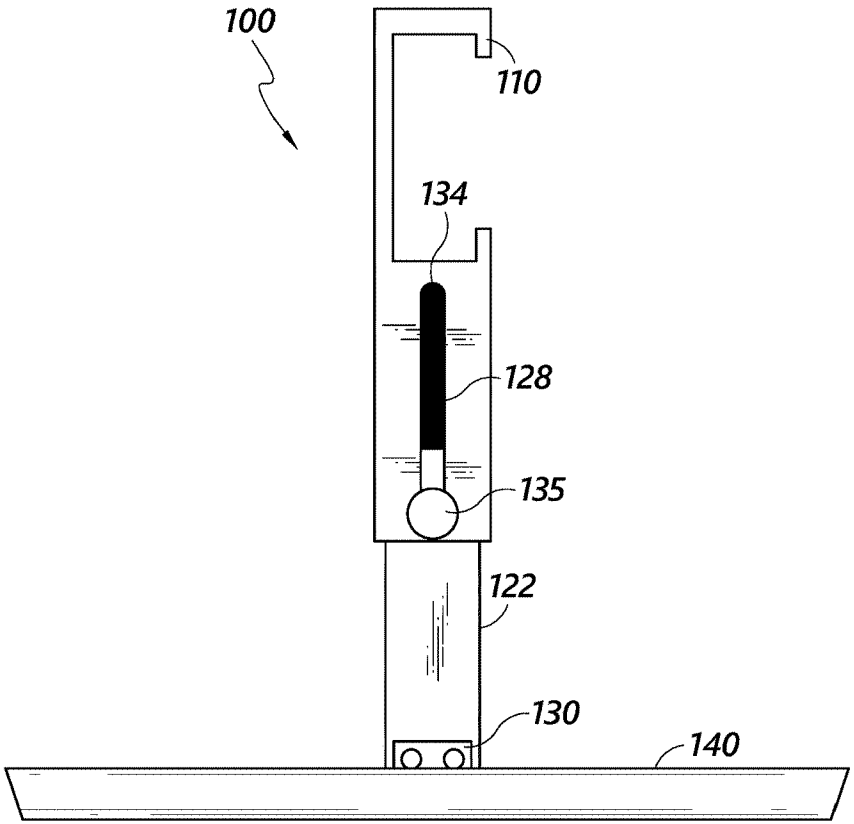
Figure 4D:
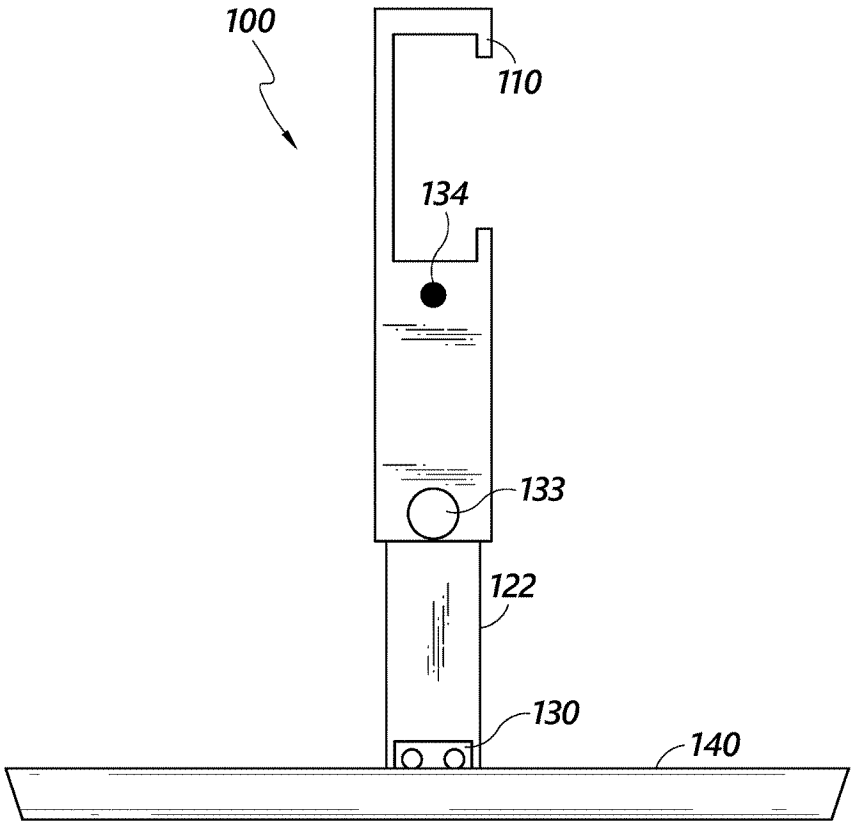

In other configurations, the device 100 can be configured to extend or retract in other manners. For example, in the configuration depicted in FIG. 4B. the work surface 140 may be affixed to the spacing 120 bar using a C-channel 125. The C-channel 125 can be configured to wrap at least part way around the perimeter of the spacing bar 120 and can be configured to slide along the longitudinal axis Y of the spacing bar 120. The C-channel can be held in place using a ball spring interface 126. By affixing the work surface 140 to the C-channel 125, such as through the use of a connecting hinge 130 or otherwise, and by allowing the C-channel 125 to traverse the longitudinal axis Y of the spacing bar 120, the work surface 140 can be positioned towards the midsection of the spacing bar 120 so that the device 100 can be collapsed. Similar to the embodiment discussed above, the C-channel 125 can be held in a collapsed state through the use of a second ball spring interface 127 disposed adjacent to the toolless mounting bracket 110. FIG. 4C presents a cross-sectional view of the C-channel 125, including a view of a suitable ball spring interface 126.

Although the foregoing has been discussed with respect to ball spring interfaces, it will be appreciated that a variety of other mechanisms may be employed to retract or extend the device 100 without deviating from the scope of the present disclosure. For instance, in other embodiments, the device 100 can be configured to fold along hinges. Likewise, in the same or different embodiments, different locking mechanisms may be employed, such as the use of push-pin interfaces, locking slots, flexible tabs, friction fittings, thumbscrews, keyed slots, and the like.

Figure 4G:
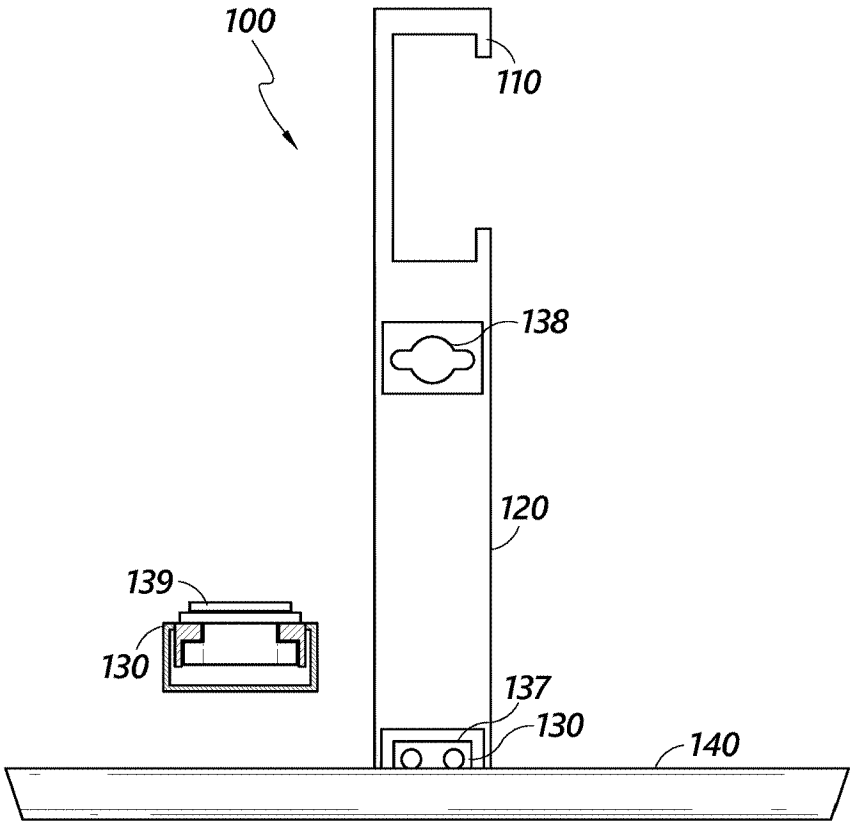
Figure 4F:
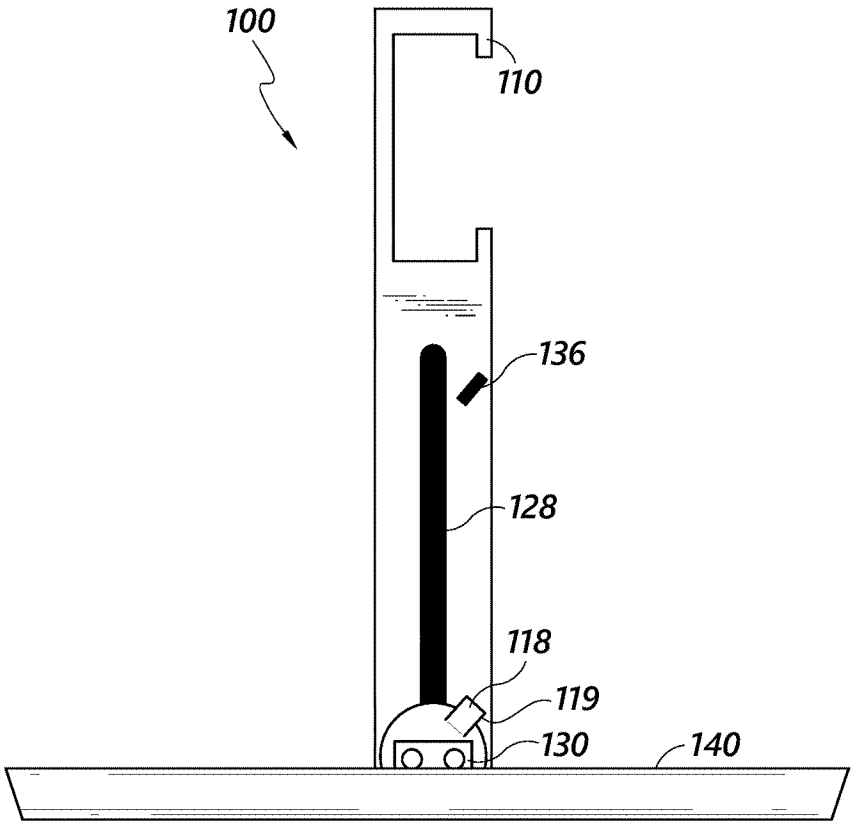

By way of example, FIGS. 4D-G depict examples of other mechanisms that may be employed to collapse or extend the device 100. The embodiment depicted in Figure D utilizes a first thumbscrew interface 133 and a second thumbscrew interface 134 which can be used to lock the device 100 in an extended or retracted configuration. Similarly, Figure E depicts another embodiment utilizing a thumbscrew 135 that tightens against sliding slot 128 to lock the device anywhere along the length of the slot 128 to allow for additional customizability of the length of the device 100. Figure F depicts an embodiment also utilizing a sliding slot 128, but in conjunction with a locking tab 118 disposed along the hinge 130 and configured to interface with tab slot 119 near the work surface 140, and a second tab slot 136 disposed near the toolless mounting bracket 110. Finally, FIG. 4G depicts an embodiment utilizing a keyed slot 138. The keyed slot 138 is disposed along the spacing bar 120 and is configured to interface with a keyed portion 139 of the hinge 130. In the depicted configuration, the hinge 130 can be detached from the spacing bar 120. In this manner, the hinge 130 and work surface 140 can be detached from the spacing bar 120 so that the keyed portion 139 of the detachable hinge 130 may interface with the keyed slot 138 to yield a collapsed device 100. From the foregoing, it will be appreciated that a variety of other similar mechanisms may be utilized to maintain the device in a collapsed or extended configuration without deviating from the present disclosure.

Figure 5:
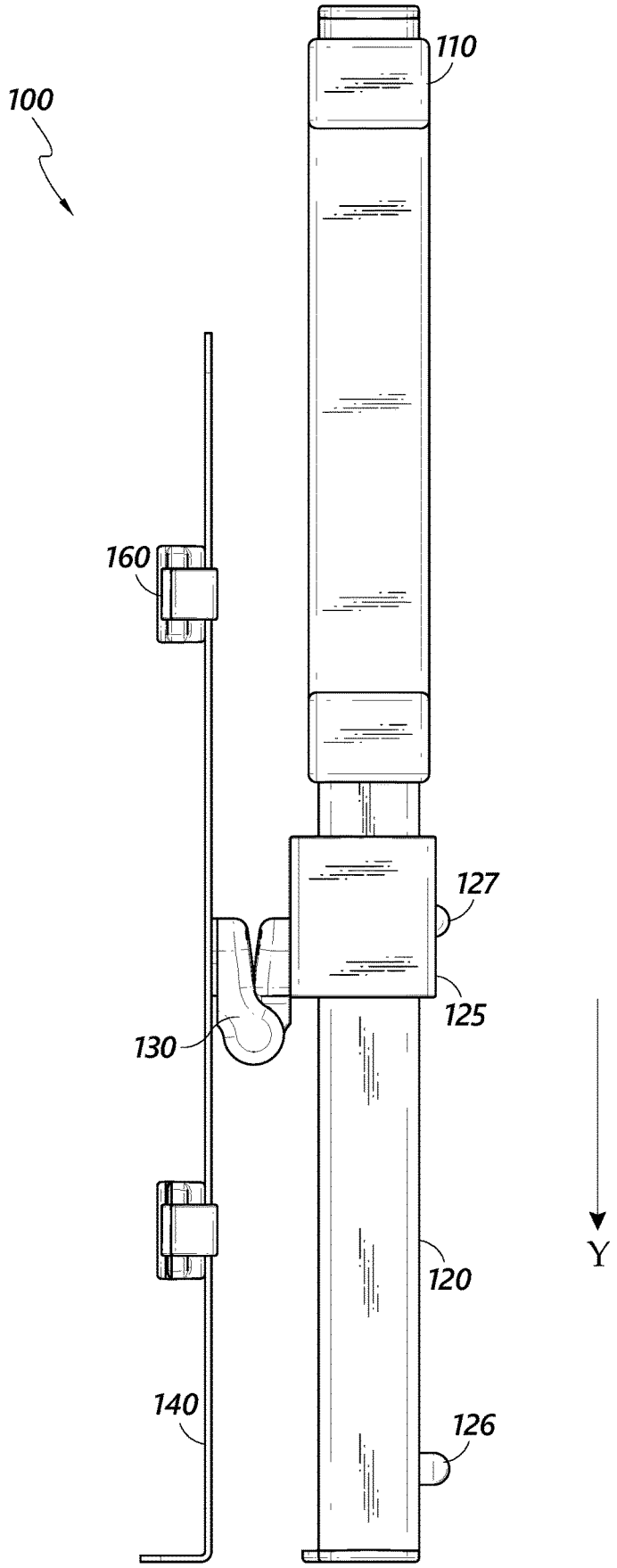
FIG. 5 depicts a removably mountable temporary work surface in a collapsed configuration.

FIG. 5 presents a view of the device 100 in a collapsed configuration. As shown in FIG. 5, the hinge 130 may be utilized to pivot the work surface 140 into proximity with the spacing bar 120 to flatten the device 100. Likewise, the device may be collapsed along its longitudinal axis Y to reduce the overall length of the device. For example, as shown in FIG. 5, the C-channel 125 may be moved towards the toolless mounting bracket 110 by actuating the first ball spring interface 126. The device may be held in a collapsed configuration by locking the C-channel 125 in place using the second ball spring interface 127. In this configuration the magnetic attachment mechanism 160 is shown removably affixed to the front of the work surface 140. In other embodiments other locking mechanisms may be employed as discussed above. Likewise, other collapsing configurations can be implemented aside from a C-channel configuration. For instance, the spacing bar 120 can be configured to telescope, contract, or extend as discussed above with respect to the foregoing embodiments.

Hinge

Figure 6B:
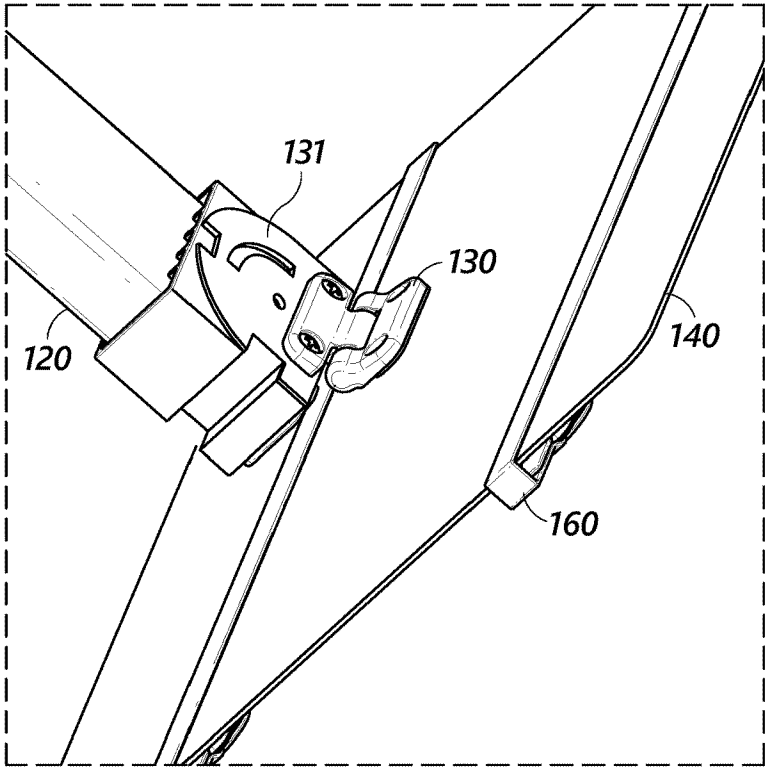
FIGS. 6A-B depict various embodiments of hinge mechanisms for use in a removably mountable temporary work surface
Figure 6A:
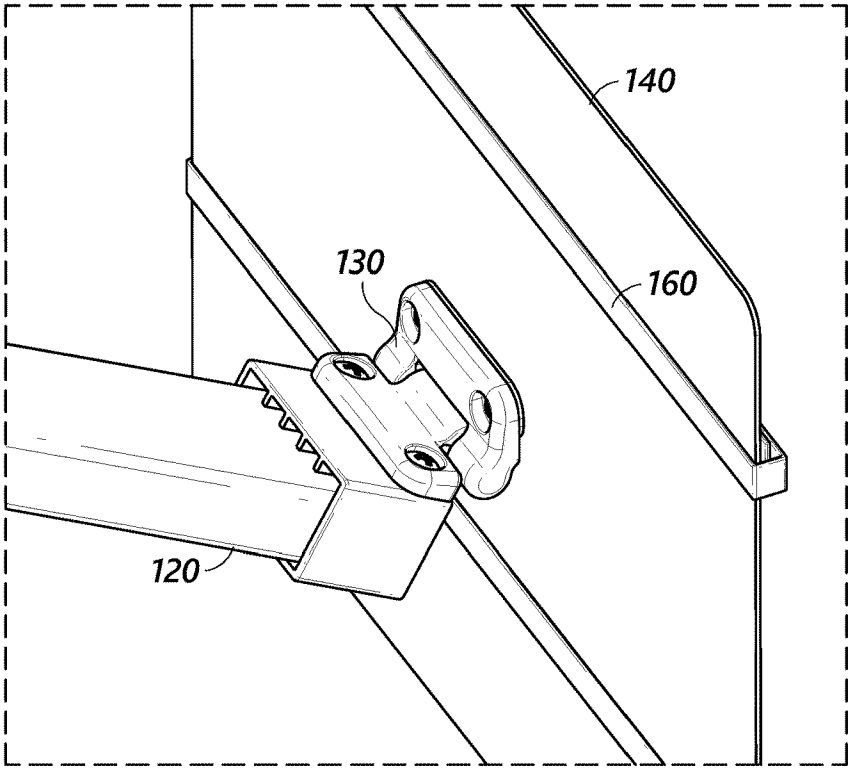

As depicted in FIG. 6A, the work surface 140 can be connected to the spacing bar 120 using a hinge 130 to allow the work surface 140 to be positioned for use, such as when the device 100 has been mounted to a beam or post. In various embodiments, the hinge 130 can provide an offset such that the work surface does not directly contact the spacing bar 120 when the work surface 140 is tilted or angled.

A variety of hinges may be implemented in accordance with the present disclosure. In some embodiments, the hinge may provide at least 1 axis of movement. FIG. 6A depicts an embodiment of a hinge providing at least 1 axis of movement. In the embodiment depicted in FIG. 6A the work surface 140 is affixed to a hinge 130 providing vertical freedom, such as a Reell® positional hinge. In this advantageous configuration, the work surface 140 can be moved or tilted into position, and the hinge 130 will maintain the desired orientation without necessitating any additional tightening, fastening, or other adjustments to maintain the work surface 140 in the desired position.

In other configurations, a hinge may be implemented to provide at least 2 axes of movement. For instance, FIG. 6B depicts a hinge mechanism providing at least 2 axes of movement. In this configuration, a first hinge 130 is connected to a rotating member 131 that allows the work surface 140 to be pitched up and down, and oriented from one side to another to improve the usability of the device.

Although the above discussion mentions the use of single and double axis hinge mechanisms including Reell® positional hinges, it will be appreciated that a variety of other movement mechanisms may be employed without deviating from the scope of the present disclosure, such as ball-and-socket joints, spring loaded hinges, kickstand notches, universal couplings, adjustable screws, or any other of a variety of joints, hinges, and couplings known to those skilled in the art.

Likewise, it will be appreciated that the hinge 130 may be affixed to the spacing bar 120 along with another element aside from or in addition to the work surface 140. For instance, in some configurations, the hinge 130 can be configured to interface with a modular mounting tip. For example, in some embodiments, the hinge 130 can be configured to couple with a tablet or similar computing device such as a mobile computer, a laptop, a smartphone, or a tablet such as an iPad®, either directly, or through the use of an intermediate coupling mechanism.

For instance, the hinge 130 may include screws that couple with an adhesive member, the adhesive member being adhered to the back surface of a computing device, although it will be appreciated that additional variations are contemplated by this disclosure, including the use of clips, hooks, or other mechanisms for coupling disparate elements. For instance, in other embodiments, the hinge 130 may be coupled with a clamping mechanism configured to clamp down around a computing device and hold the computing device in a usable position. In other embodiments, the hinge 130 may be configured to couple with a mounting mechanism, such as a VESA mounting mechanism or other suitable apparatus for mounting a screen, monitor, or other display device. Likewise, the hinge may be configured to adapt with a case for a phone, tablet, or other computing device to allow a user to mount the computing device onto the system to establish a temporary work surface for the computing device.

Work Surface

Figure 7B:
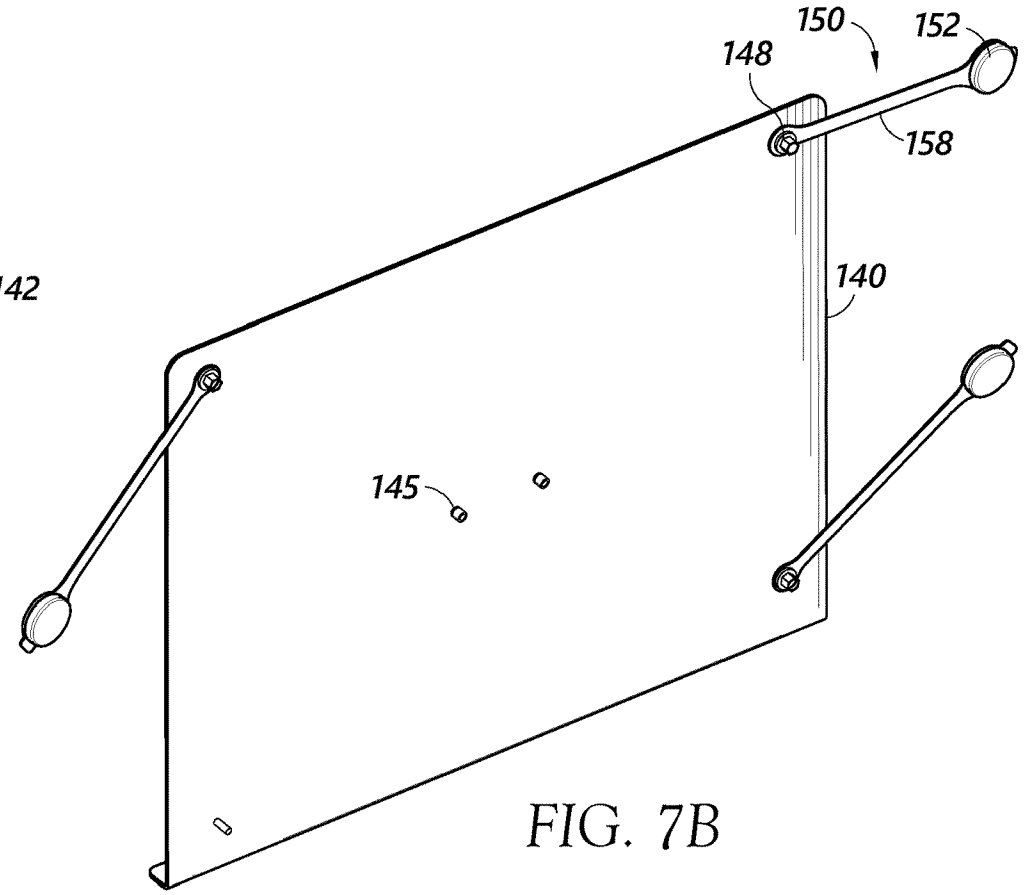
FIGS. 7A-C present perspective front and back views, and a schematic view of a work surface for use in a removably mountable temporary work surface.
Figure 7A:
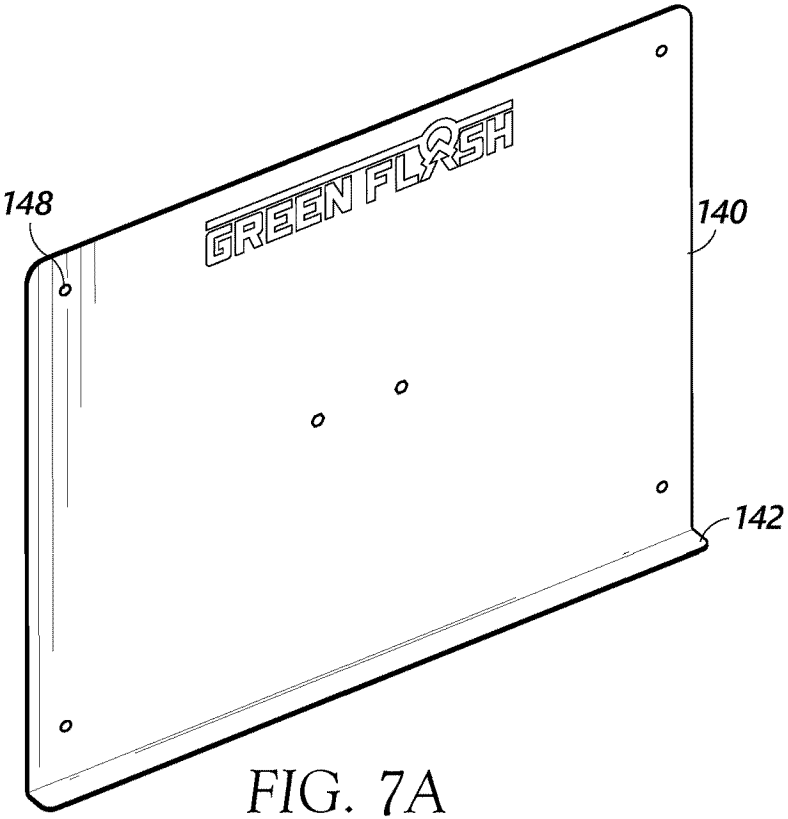
Figure 7C:
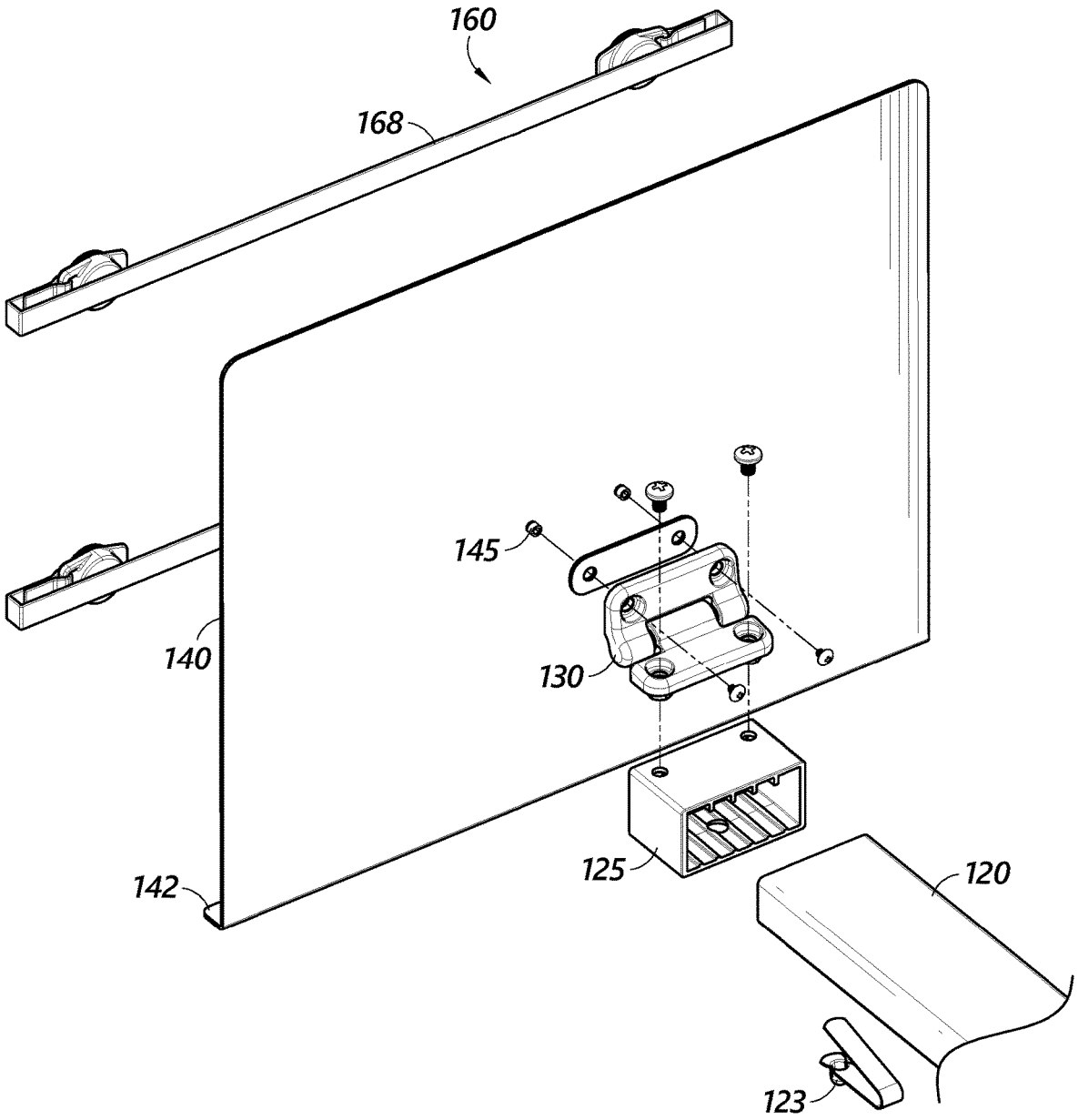

A suitable work surface prepared in accordance with this disclosure is illustrated in FIGS. 7A-C. FIG. 7A depicts an orthographic view of the front of a suitable work surface 140. The illustrated embodiment includes a lip 142 implemented along the lower edge of the work surface 140 which can help to retain documents or other contents thereto. Although the present embodiment is illustrated with a single lip 142 positioned along the lower edge of the work surface 140, it will be appreciated that one or more lips, edges, or outcroppings may be implemented without deviating from the scope of the present disclosure. For instance, in other embodiments more than one lip may be implemented along one or more edges of the work surface 140. For example, in some embodiments, each edge of the work surface 140 may present a raised edge or lip to help prevent objects from falling off of the work surface 140.

Nevertheless, it will be appreciated that additional and alternate work surfaces that are useful for documents or a variety of other objects are similarly contemplated by this disclosure. For instance, in some configurations, the work surface may include retaining bands or straps to clamp a device to the surface. By way of example, the work surface may include a clamping device configured to clamp around and retain one or more devices, such as a mobile computing device including tablets, laptops, smartphones, and the like, to the work surface to provide a removable and easily relocatable temporary workspace. In other embodiments, the work surface may include one or more straps that can be configured to wrap around and retain a device to the work surface. In still further configurations, the work surface may be configured with a textured, high friction, or adhesive surface that can be used to retain objects on its surface, such as a tablet or mobile computing device.

In various advantageous configurations, the work surface 140 can be customized for use in a particular setting. For instance, in some configurations, the work surface 140 is sized for use in a construction environment. By way of example, typical residential framing is 16" on center, or 24" on center using nominal 2"×4" boards, 2"×6" boards, or 2"×8" boards. Accordingly, typical residential framing studs can be found about 14.5" apart, about 16" apart, about 22.5" apart, about 24" apart, or any value therein. In view of these dimensions, the work surface 140 can be sized to yield a substantially contiguous surface when multiple devices are mounted to adjacent framing posts. For instance, the work surface 140 can have a width of about 15" so that the device will form a substantially contiguous surface with about an inch between each work surface when multiple devices are mounted to adjacent framing posts. In other configurations, the work surface 140 may have a width of about 12", 14.5", 16", 22.5", 24", or any value therein. In this manner, multiple devices can be mounted to a plurality of adjacent framing posts to form a substantially contiguous desk suitable for viewing or working on larger documents, such as blueprints or other plans. However, it will be appreciated that other dimensions are contemplated for use in similar or other environments. For instance, in some embodiments, the work surface may have a width greater than 24" to support blueprints with only a single device. In other configurations, the work surface may have a width less than 14.5" so that the device can be wedged into tight spaces, or to mount to smaller and narrower framing. In some embodiments, a work surface width is selected such that small gaps of about 0.5" to about 5" separate each of the adjacent work surfaces. These small gaps can facilitate the mounting and adjustment of multiple devices on adjacent posts. However, these gaps are small enough to prevent larger documents, such as blueprints, from falling between adjacently mounted devices.

In various configurations the work surface 140 can be made from a variety of materials, such as wood, polymers, composites, metals, and the like. In some advantageous configurations, the work surface is made from a magnetic metal, which can facilitate the use of magnets to retain contents on the work surface. For example, in some embodiments the work surface 140 can be prepared from—or may include—a magnetic metal such as steel. In this advantageous configuration, magnetic attachment mechanisms 150 can be implemented on the work surface 140 to help retain documents or other contents thereto.

FIG. 7B depicts an orthographic view of the back of a suitable work surface 140 prepared in accordance with the present disclosure. The work surface 140 depicted in FIG. 7B shows four magnetic attachment points 148 disposed on the rear of the work surface. Three of the pictured magnetic attachment points 148 are connected to a magnetic attachment mechanism, such as magnetic tether 150. By placing the magnetic attachment points 148 on the rear side of the work surface 140, the usable space of the work surface 140 is maximized and left unobstructed by the magnetic attachment points 148, presenting a greater working area than other designs utilizing clips or other similar attachment mechanisms disposed within or otherwise on top of the usable surface area of the work surface. Also depicted in FIG. 7B is the at least one hinge attachment point 145. Similar to the magnetic attachment points 148, the hinge attachment 145 is disposed on the rear of the work surface to maximize the usable area. The hinge attachment point 145 may be utilized to affix the work surface 140 to one or more of a hinge or a spacing bar as shown in other figures.

In some embodiments, the work surface may include a magnetic attachment mechanism that can be separated from the device and does not require a magnetic attachment point to interface with the work surface. For example, in some embodiments a strap-style magnetic interface may be implemented that is configured to wrap around the work surface. An exemplary embodiment of such a system is depicted in FIG. 7C. As shown in FIG. 7C, the work surface 140 does not include magnetic attachment points 148, though such points could be implemented in this embodiment if desired. As shown, the magnetic attachment mechanism 160 includes a flexible tether 168, such as a nylon tether or silicon tether or other flexible material. Disposed at opposite ends of the flexible tether 168 are magnets 162 configured to interface with the metallic work surface 140. Namely, a major portion of the flexible tether 168 may be disposed along the back of the work surface 140 to allow the magnets 162 to be positioned on the front of the worksurface to removably affix materials thereto without obstructing the work surface with mounting mechanisms.

Magnetic Attachment Mechanisms

Figure 8:
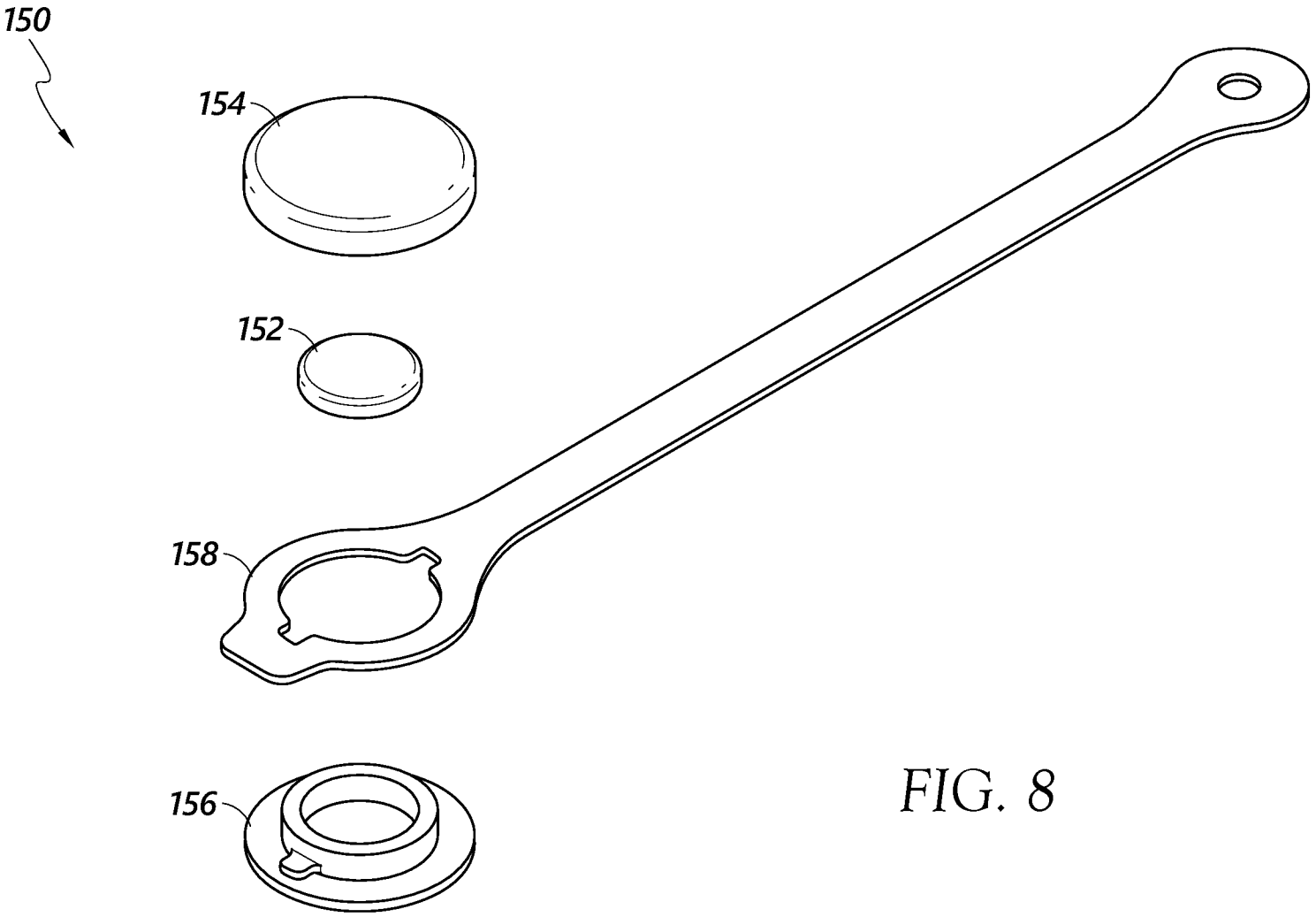
FIG. 8 presents a schematic view of a magnetic mechanism for use in a removably mountable temporary work surface.

As discussed above, in some advantageous configurations, the work surface may be prepared from a magnetic metal to facilitate the use of a magnetic attachment mechanism, such as magnetic tether which can be used to retain documents or other contents onto the work surface. FIG. 8 depicts an embodiment of a suitable magnetic attachment mechanism 150 which can be affixed to a work surface. In the illustrated embodiment, the magnetic attachment mechanism 150 includes a magnet 152 disposed between an upper magnet covering 154 and a lower magnetic covering 156. The upper magnet covering 154 and a lower magnetic covering 156 can thereby envelop the magnet 152 and affix it to a tether 158. The upper magnet covering 154, lower magnetic covering 156, and tether 158 can be prepared from a flexible material such as nylon, silicon or a polymer, such as a rubber, to allow the magnets to flex so that they can be positioned nearly anywhere on the front of the work surface or stowed and affixed to the rear of the work surface when not in use. Such magnetic tether mechanisms present significant advantages over rigid clips or hooks which are typically disposed within the usable surface area of competing devices, which cannot be moved around the work surface to retain irregularly shaped documents or items, and which cannot be stowed out of the way on the back of the device when not in use.

Figure 9:
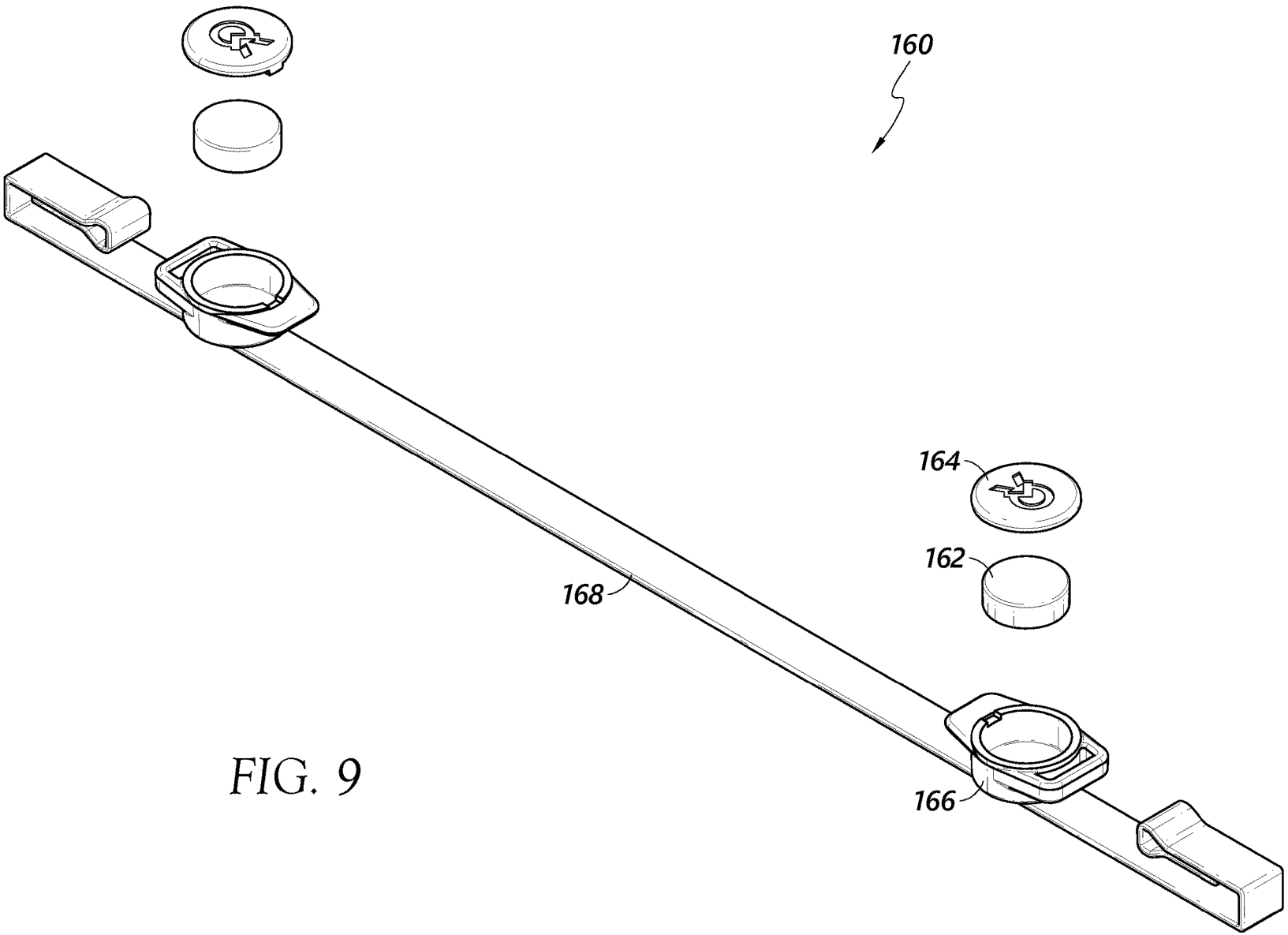
FIG. 9 presents a schematic view of a magnetic mechanism for use in a removably mountable temporary work surface.

Likewise, FIG. 9 presents another example of an exemplary embodiment of a magnetic attachment system 160. The magnetic attachment system 160 includes a tether 168. The tether 168 may be prepared from any flexible material. It has been found that nylon is a particularly advantageous material for this implementation due to its strength and flexibility, but other materials are workable as well including various polymers and fabrics such as silicon, cotton, polyester, or any of a variety of materials that are flexible and resistant to tearing. Affixed to either end of the tether 168 is a lower magnet housing 166. The lower magnet housing 166 can include a tether hook that can be configured to interface with the tether 168. In some embodiments, the tether 168 is routed through the tether hook and then the tether 168 is sewn back onto itself to affix the tether 168 to the tether hook. Likewise, the lower magnet housing 166 can be adhered to the upper magnet housing 164 through a variety of mechanisms such as the use of friction fittings, glues, or other mechanisms for adhesion. In some particularly advantageous configurations, the lower magnet housing 166 is ultrasonically welded to the upper magnet housing 164 after the tether 168 has been routed through the tether hook and sewn back onto itself to yield a completed magnetic attachment mechanism 160 suitable for removably affixing documents or other items to the work surface 140.

Certain Terminology

The present disclosure provides a detailed description of various embodiments of a removably mountable temporary work surface. Although certain aspects, advantages, and features are described herein, it is not necessary that any particular embodiment include or achieve any or all of those aspects, advantages, or features. Some embodiments may not achieve the advantages described herein but may achieve other advantages instead. Any structure, material, feature, or step in any embodiment can be used in place of, or in addition to, any structure, feature, or step in any other embodiment, or omitted. This disclosure contemplates all combinations of features from the various disclosed embodiments. No feature, structure, or step is essential or indispensable.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B, and C" can include a first processor configured to carry out recitation A working in conjunction with a second processor configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes, or tends toward, a particular value, amount, or characteristic. As an example, in certain embodiments, as the context may dictate, the term "generally parallel" can refer to something that departs from exactly parallel by less than or equal to 20 degrees and/or the term "generally perpendicular" can refer to something that departs from exactly perpendicular by less than or equal to 20 degrees.

Overall, the language of the claims is to be interpreted broadly based on the language employed in the claims. The claims are not to be limited to the non-exclusive embodiments and examples that are illustrated and described in this disclosure, or that are discussed during the prosecution of the application.

The following is claimed:

1. A removably mountable temporary work surface, comprising:

a mounting system;

a spacing bar; and a work surface connected to the spacing bar by a hinge; wherein the spacing bar includes:

at least two locking mechanisms disposed along the length of the spacing bar; and a C-channel configured to slide along the length of the spacing bar and to interface with the one or more of the at least two locking mechanisms to lock the C-channel at one or more predetermined point along the length of the spacing bar.

2. The removably mountable temporary work surface of claim 1, wherein the mounting system comprises a friction fit bracket having no moving parts.

3. The removably mountable temporary work surface of claim 2, wherein the friction fit bracket is configured to mount to construction framing.

4. The removably mountable temporary work surface of claim 1, further comprising a magnetic attachment mechanism.

5. The removably mountable temporary work surface of claim 4, wherein the magnetic attachment mechanism includes at least two magnets affixed to opposite ends of a tether, the tether having more flexibility than the spacing bar.

6. The removably mountable temporary work surface of claim 4, wherein the work surface includes a metallic material configured to interface with the magnetic attachment mechanism.

7. The removably mountable temporary work surface of claim 1, wherein the mounting system comprises a friction fit bracket, wherein the friction fit bracket includes at least three internal edges and a lateral gap, configured such that:

the first internal edge is disposed parallel to the second internal edge;

the first and second internal edges are separated by a third internal edge that is disposed perpendicular to the first and second internal edges, the third internal edge disposed parallel to the lateral gap.

8. The removably mountable temporary work surface of claim 7, comprising:

a mounting system including a friction fit bracket, wherein the friction fit bracket has at least three internal edges and a lateral gap, configured such that:

the first internal edge is disposed parallel to the second internal edge;

the first and second internal edges are separated by, and connected to, a third internal edge disposed perpendicular to the first and second internal edges and the lateral gap;

wherein the first internal edge is further connected to a fourth internal edge parallel to the third internal edge; and wherein the second internal edge is further connected to a fifth internal edge parallel to the third internal edge.

9. The removably mountable temporary work surface of claim 8, wherein:

the first internal edge has a length of about 1.5";

the second internal edge has a length of about 1.5"; and the third internal edge has a length of about 6.25".

10. The removably mountable temporary work surface of claim 8, wherein the first and second edges include a polymer covering.

11. The removably mountable temporary work surface of claim 8, wherein the first and second edges include a grooved surface.

12. The removably mountable temporary work surface of claim 8, wherein:

the first internal edge is connected to a fourth internal edge having a length of about 0.625";

the second internal edge is connected to a fifth internal edge having a length of about 0.625";

wherein the non-connecting ends of the members defining fourth and fifth internal edges define the lateral gap.

13. The removably mountable temporary work surface of claim 1, wherein the at least two locking mechanisms include at least one ball-spring interface.

14. The removably mountable temporary work surface of claim 1, wherein the removably mountable temporary work surface is configured to position a computing a device for use.

15. The removably mountable temporary work surface of claim 1, wherein the work surface is affixed to the spacing bar by a hinge configured to provide at least one axis of movement to the work surface.

16. The removably mountable temporary work surface of claim 1, further comprising a magnetic attachment mechanism, wherein the magnetic attachment mechanism includes a magnet disposed within a housing affixed to a tether removably mountable to the work surface.

17. The removably mountable temporary work surface of claim 1, wherein the work surface is sized to form a contiguous surface when a plurality of devices is mounted to adjacent framing posts.

18. The removably mountable temporary work surface of claim 17, wherein the work surface has a width selected from about 14.5", about 16", about 22.5", or about 24".

19. A removably mountable temporary work surface configured to be mounted to construction framing, the removably mountable temporary work surface comprising:

a mounting system including a friction fit bracket;

wherein the friction fit bracket has at least five internal edges and a lateral gap, configured such that:

the first internal edge has a length of about 1.5", is disposed parallel to the second internal edge, and is connected to a member defining a fourth internal edge having a length of about 0.625";

the second internal edge has a length of about 1.5", is separated from the first internal edge by a third internal edge having a length of about 6.25", and is disposed perpendicular to the first and second internal edges, such that the third internal edge is disposed parallel to the lateral gap;

the second internal edge is further connected to a member defining a fifth internal edge having a length of about 0.625";

wherein the non-connecting ends of the members defining the fourth and fifth internal edges define the lateral gap disposed parallel to the third internal edge;

a spacing bar including:

at least two locking mechanisms disposed along the length of the spacing bar; and a C-channel configured to slide along the length of the spacing bar and to interface with the one or more of the at least two locking mechanisms to lock the C-channel at one or more predetermined point along the length of the spacing bar;

a work surface prepared from a metallic material having:

a width of about 14.5"; and at least one magnetic attachment mechanism including two magnetic elements affixed by a tether, the tether having more flexibility than the spacing bar.

* * * * *